US011827012B2

(12) United States Patent
Takezawa

(10) Patent No.: US 11,827,012 B2
(45) **Date of Patent: *Nov. 28, 2023**

(54) RECORDING APPARATUS CAPABLE OF PRINTING ELASTIC MEDIUM

(71) Applicant: KYOCERA Document Solutions Inc., Osaka (JP)

(72) Inventor: Mashio Takezawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 94 days.

This patent is subject to a terminal disclaimer.

(21) Appl. No.: 17/648,881

(22) Filed: Jan. 25, 2022

(65) Prior Publication Data

US 2022/0234370 A1 Jul. 28, 2022

(30) Foreign Application Priority Data

Jan. 28, 2021 (JP) ..... 2021-011684

(51) Int. Cl.

| | |
|---|---|
| ***B41J 11/00*** | (2006.01) |
| ***B41J 15/04*** | (2006.01) |
| ***B41J 15/16*** | (2006.01) |
| ***B41J 3/407*** | (2006.01) |
| ***B65H 23/038*** | (2006.01) |

(Continued)

(52) U.S. Cl.

CPC ..... *B41J 11/0005* (2013.01); *B41J 3/4078* (2013.01); *B41J 11/0015* (2013.01); *B41J 11/04* (2013.01); *B41J 15/16* (2013.01); *B65H 23/025* (2013.01); *B65H 23/038* (2013.01); *B65H 23/18* (2013.01); *B65H 23/26* (2013.01); *D06B 23/023* (2013.01); *D06C 3/06* (2013.01)

(58) Field of Classification Search

CPC .. B41J 11/0005; B41J 11/0015; B41J 15/046; B41J 15/16; B41J 3/4078; B65H 23/038; B65H 23/025; B65H 23/18; B65H 23/26; D06C 3/06; D06B 23/023

See application file for complete search history.

(56) References Cited

U.S. PATENT DOCUMENTS

2022/0234365 A1* 7/2022 Takezawa ..... B41J 3/4078

FOREIGN PATENT DOCUMENTS

CN 205329355 U * 6/2016
CN 106986217 A * 7/2017

(Continued)

*Primary Examiner* — Justin Seo
*Assistant Examiner* — Kendrick X Liu
(74) *Attorney, Agent, or Firm* — Alleman Hall Creasman & Tuttle LLP

(57) ABSTRACT

A recording apparatus includes a printing portion and a first conveying portion. The printing portion ejects liquid to print a medium having elasticity. The first conveying portion is disposed upstream of the printing portion in a conveying direction along which the medium is conveyed to the printing portion. The first conveying portion includes at least two conveying bodies disposed in the conveying direction and around which the medium is alternately wound. The conveying bodies each include a shaft extending in a width direction orthogonal to the conveying direction and a plurality of rollers rotatably supported by the shaft. The plurality of rollers are supported to be inclined outward with respect to the conveying direction from upstream to downstream in the conveying direction.

14 Claims, 8 Drawing Sheets

(51) Int. Cl.

| | |
|---|---|
| ***B65H 23/025*** | (2006.01) |
| ***B65H 23/18*** | (2006.01) |
| ***B65H 23/26*** | (2006.01) |
| ***D06C 3/06*** | (2006.01) |
| ***D06B 23/02*** | (2006.01) |
| ***B41J 11/04*** | (2006.01) |

(56) References Cited

FOREIGN PATENT DOCUMENTS

| | | | | |
|---|---|---|---|---|
| EP | 1215327 B1 * | 9/2007 | ..... | B65H 23/0251 |
| JP | 2019105002 A | 6/2019 | | |

* cited by examiner

RECORDING APPARATUS CAPABLE OF PRINTING ELASTIC MEDIUM

INCORPORATION BY REFERENCE

This application is based upon and claims the benefit of priority from the corresponding Japanese Patent Application No. 2021-011684 filed on Jan. 28, 2021, the entire contents of which are incorporated herein by reference.

BACKGROUND

The present disclosure relates to a recording apparatus that prints elastic medium by an inkjet method.

There is known an inkjet textile printing apparatus that prints fabric by an inkjet method. The inkjet textile printing apparatus includes a sheet conveying portion that conveys a long recording sheet, an inkjet recording portion that ejects ink to the recording sheet conveyed by the sheet conveying portion to form an image, and a sheet collecting portion that collects the recording sheet on which the image is formed by the inkjet recording portion.

SUMMARY

A recording apparatus of the present disclosure includes a printing portion and a first conveying portion. The printing portion ejects liquid to print a medium having elasticity. The first conveying portion is disposed upstream of the printing portion in a conveying direction along which the medium is conveyed to the printing portion. The first conveying portion includes at least two conveying bodies disposed in the conveying direction and around which the medium is alternately wound. The conveying bodies each include a shaft extending in a width direction orthogonal to the conveying direction and a plurality of rollers rotatably supported by the shaft. The plurality of rollers are supported to be inclined outward with respect to the conveying direction from upstream to downstream in the conveying direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes a recording apparatus according to an embodiment of the present disclosure with reference to the accompanying drawings.

Figure 1:
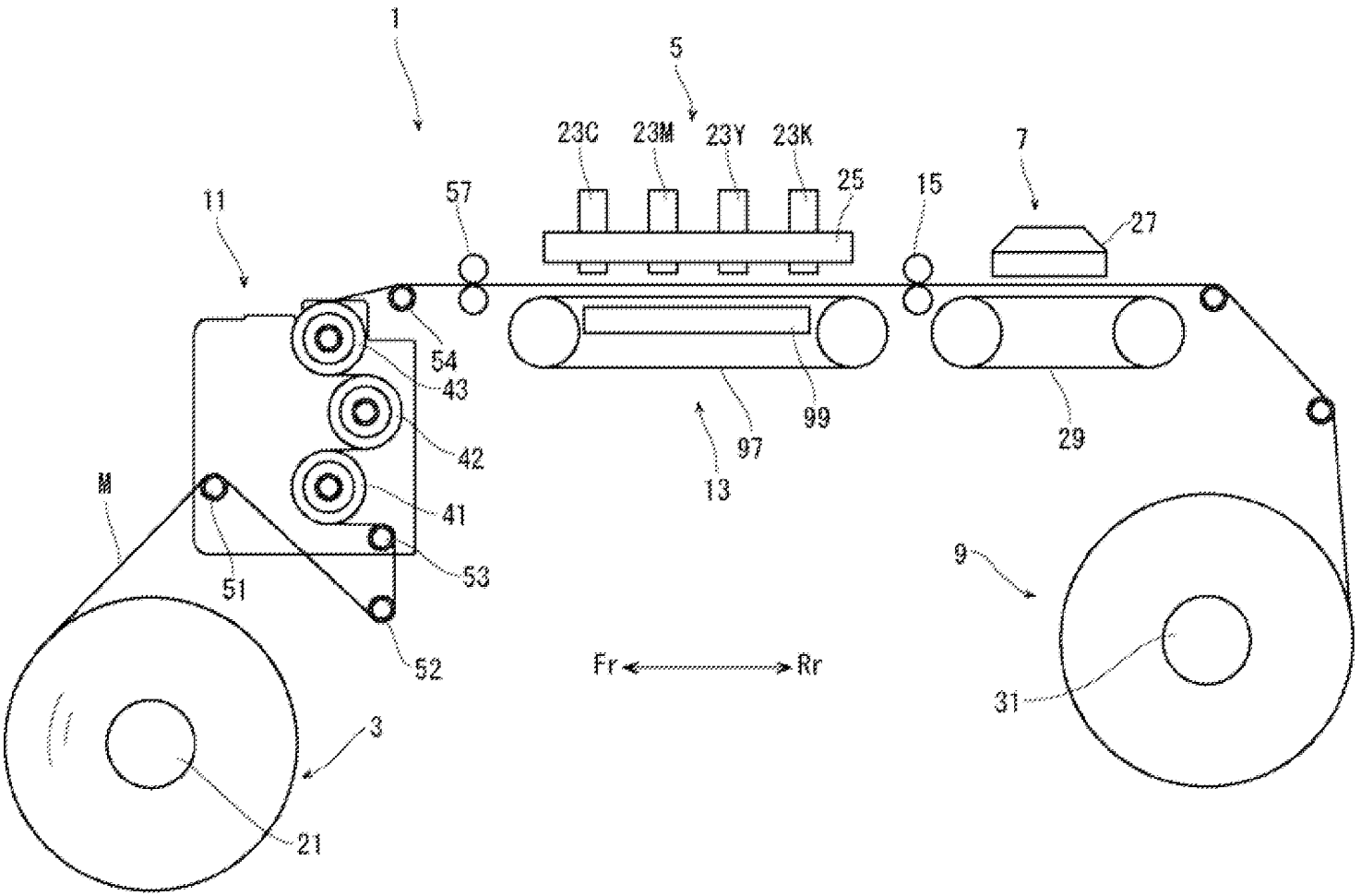
FIG. 1 is a schematic side view of a recording apparatus according to an embodiment of the present disclosure.

The overall configuration of a recording apparatus 1 will now be described with reference to FIG. 1. FIG. 1 is a schematic side view of the recording apparatus 1. The recording apparatus 1 prints a medium M such as fabric that stretches in longitudinal and transverse directions by an inkjet method. In FIG. 1, the left side on the page corresponds to the front side of the recording apparatus 1. Fr, Rr, L, and R in the drawings respectively denote the front side, rear side, left side, and right side of the recording apparatus 1.

The recording apparatus 1 includes a supply roller 3 around which the long medium M is wound, a printing portion 5 that prints the medium M supplied from the supply roller 3 by an inkjet method, a drying portion 7 that dries the medium M printed by the printing portion 5, and a winding roller 9 that winds the medium M dried by the drying portion 7. Furthermore, the recording apparatus 1 includes a first conveying portion 11 that conveys the medium M in a conveying direction from the supply roller 3 to the printing portion 5 and a second conveying portion 13 that conveys the medium M conveyed by the first conveying portion 11 to the drying portion 7 while keeping the medium M facing the printing portion 5.

The supply roller 3 includes a rotation shaft 21 around which the medium M is wound to be attached and a motor (not shown) that rotates the rotation shaft 21 in a predetermined rotation direction. The motor rotates the rotation shaft 21 in the predetermined direction at a predetermined rotational speed to unwind the medium M from the rotation shaft 21 downstream in the conveying direction.

The printing portion 5 includes four recording heads 23C, 23M, 23Y, and 23K. The four recording heads 23C, 23M, 23Y, and 23K are supplied with ink of cyan, magenta, yellow, and black, respectively. The four recording heads 23C, 23M, 23Y, and 23K are aligned in the conveying direction and supported by a head housing 25 with their ejection ports facing downward.

The drying portion 7 includes a fan 27 and a belt conveying portion 29. The fan 27 is disposed with its air outlet facing downward. The belt conveying portion 29 includes an endless belt wound around a drive roller and a driven roller. The belt conveying portion 29 is disposed such that the upper path of the endless belt faces the air outlet of the fan 27 with a predetermined space therebetween.

The winding roller 9 includes a rotation shaft 31 around which the medium M is wound to be collected and a motor (not shown) that rotates the rotation shaft 31 in a predetermined rotation direction. The motor rotates the rotation shaft 31 in the predetermined direction at a predetermined rotational speed to wind the medium M around the rotation shaft 31.

It is difficult for a known textile printing apparatus to stably convey an elastic recording sheet such as fabric. Forming an image on an unstable recording sheet prevents a desired drawing performance from being achieved. By contrast, the recording apparatus 1 according to the embodiment of the present disclosure can perform textile printing while stably conveying an elastic medium as described below.

Figure 2:
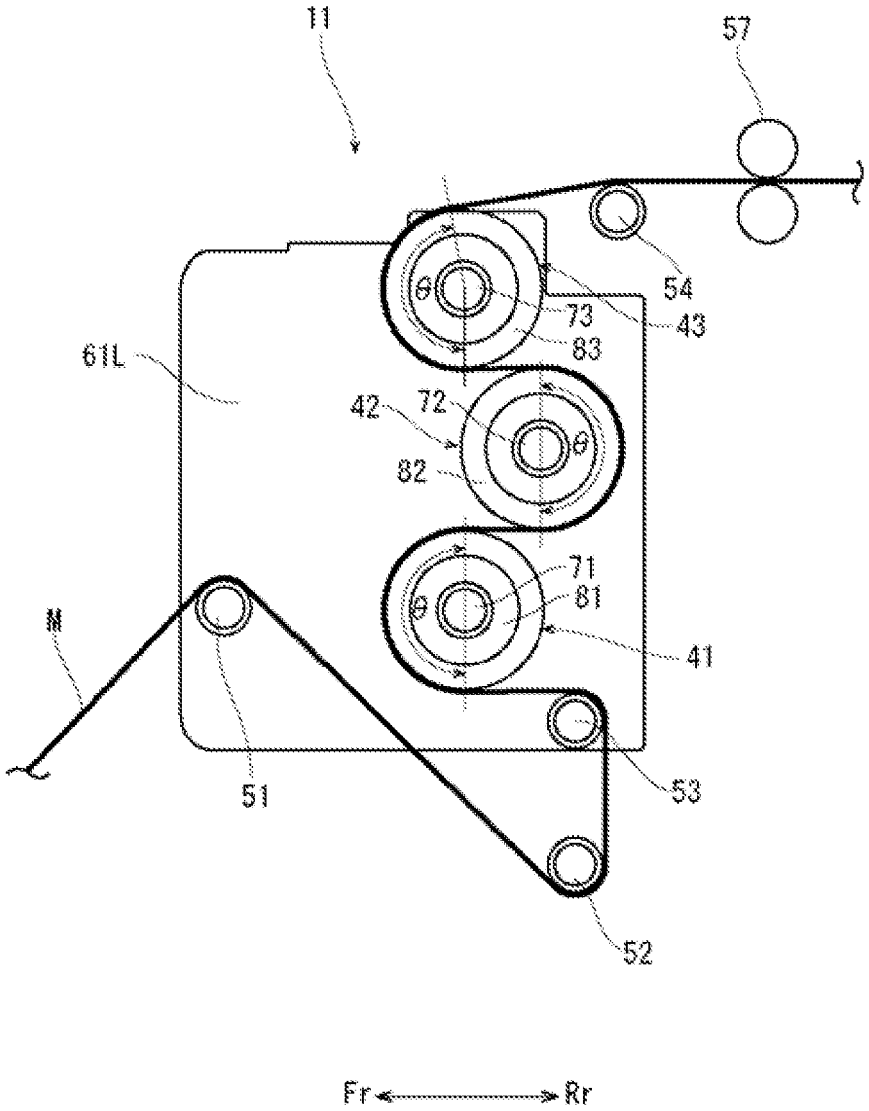
FIG. 2 is a side view of a first conveying portion in the recording apparatus according to the embodiment of the present disclosure.
Figure 3:
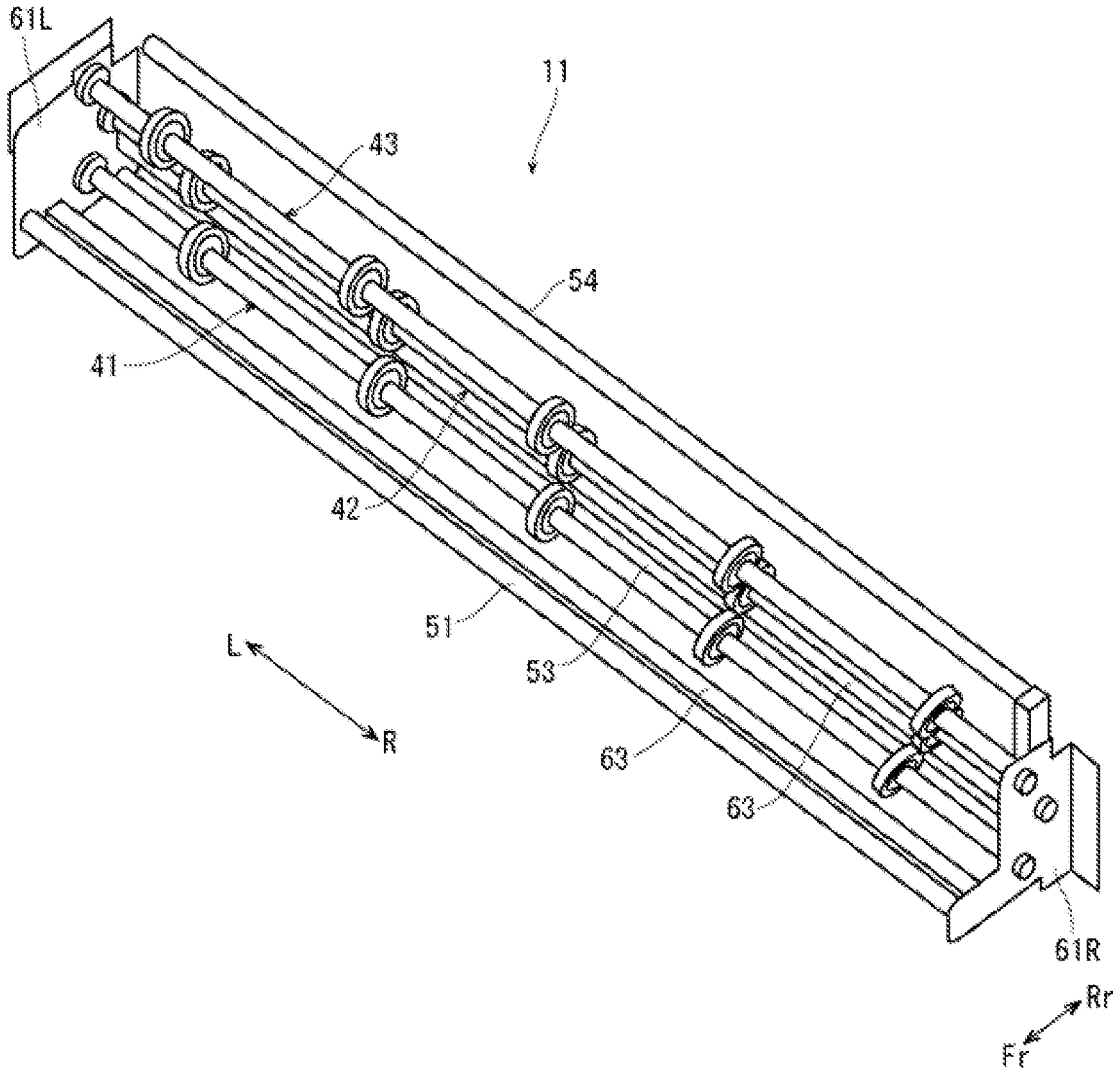
FIG. 3 is a perspective view of the first conveying portion in the recording apparatus according to the embodiment of the present disclosure.

The following describes the first conveying portion 11 with reference to FIGS. 2 and 3. FIG. 2 is a side view of the first conveying portion 11, and FIG. 3 is a perspective view of the first conveying portion 11.

The first conveying portion 11 includes first to third conveying bodies 41, 42, and 43; first to fourth tension rollers 51, 52, 53, and 54; and a first conveying roller pair 57. The medium M is wound around the first tension roller 51, the second tension roller 52, the third tension roller 53, the first conveying body 41, the second conveying body 42, the third conveying body 43, and the fourth tension roller 54 in this order from upstream to downstream in the conveying direction.

As shown in FIG. 3, the first and third tension rollers 51 and 53 and the first to third conveying bodies 41, 42, and 43 are supported by a pair of left and right side plates 61L and 61R at both respective ends thereof. The pair of side plates 61L and 61R are connected by two stays 63 and supported by the housing (not shown) of the recording apparatus 1. Both ends of the second tension roller 52 are supported by the housing. One end of the fourth tension roller 54 is supported by the right side plate 61R, and another end is supported by the housing.

Figure 4:
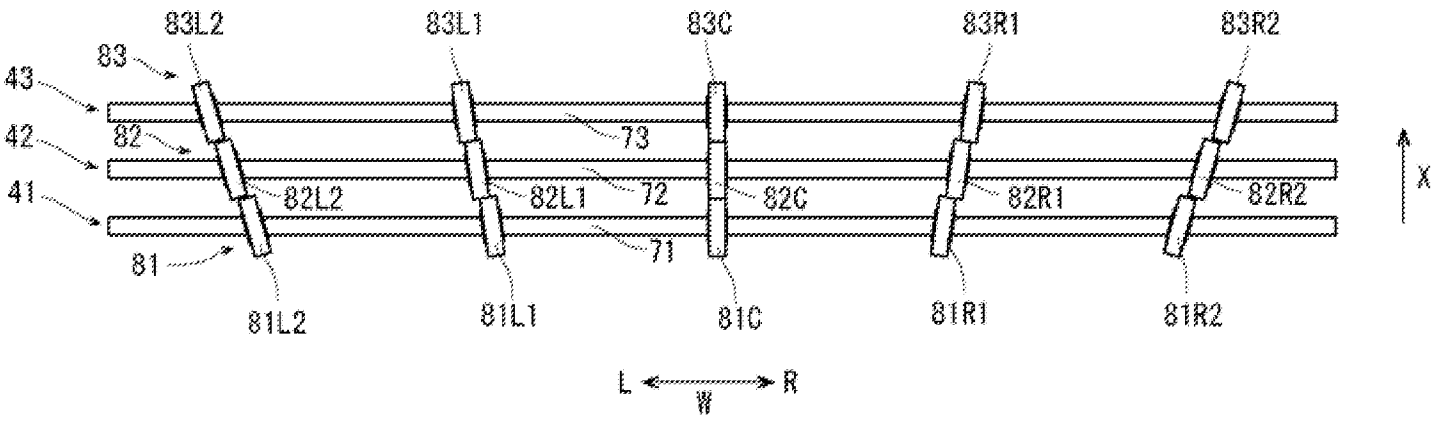
FIG. 4 is a front view of first to third conveying bodies in the recording apparatus according to the embodiment of the present disclosure.
Figure 5:
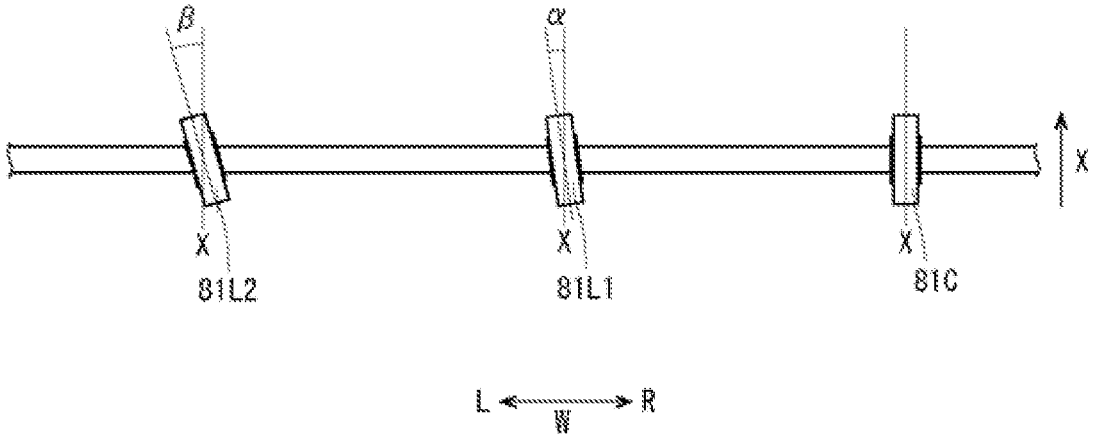
FIG. 5 is a partial front view of the first conveying body in the recording apparatus according to the embodiment of the present disclosure.

The following describes the first to third conveying bodies 41, 42, and 43 with reference to FIGS. 4 and 5 in addition to FIGS. 2 and 3. FIG. 4 is a front view of the first to third conveying bodies 41, 42, and 43, and FIG. 5 is a partial front view of the first conveying body 41.

As shown in FIG. 4, the first to third conveying bodies 41, 42, and 43 include first to third shafts 71, 72, and 73, respectively, extending in a width direction W (left-right direction) orthogonal to a conveying direction X (indicated as a direction parallel to the up-down direction in FIG. 4 for convenience), and include first to third rollers 81, 82, and 83 rotatably supported by the first to third shafts 71, 72, and 73, respectively.

The first to third rollers 81, 82, and 83 respectively include five rollers. The five rollers of the first to third rollers 81, 82, and 83 respectively include middle rollers 81C, 82C, and 83C disposed in the middle in the width direction W; first left rollers 81L1, 82L1, and 83L1 disposed to the left of the middle in the width direction W (on the outer side in the width direction W); second left rollers 81L2, 82L2, and 83L2 disposed to the left of the first left rollers 81L1, 82L1, and 83L1 (on the outer side in the width direction W); first right rollers 81R1, 82R1, and 83R1 disposed to the right of the middle in the width direction W (on the outer side in the width direction W); and second right rollers 81R2, 82R2, and 83R2 disposed to the right of the first right rollers 81R1, 82R1, and 83R1 (on the outer side in the width direction W). Hereafter, for convenience, the first left rollers 81L1, 82L1, and 83L1 may also be collectively referred to as first left rollers L1; the second left rollers 81L2, 82L2, and 83L2 may also be collectively referred to as second left rollers L2; the first right rollers 81R1, 82R1, and 83R1 may also be collectively referred to as first right rollers R1; and the second right rollers 81R2, 82R2, and 83R2 may also be collectively referred to as second right rollers R2.

The first left rollers L1 and the first right rollers R1 are symmetric to each other about the middle (middle rollers 81C, 82C, and 83C) in the width direction W. Similarly, the second left rollers L2 and the second right rollers R2 are symmetric to each other about the middle in the width direction W.

In addition, the first and second left rollers L1 and L2 and the first and second right rollers R1 and R2 are supported to be inclined outward with respect to the conveying direction X from upstream to downstream in the conveying direction X. That is, the first and second left rollers L1 and L2 are inclined from the middle to the left in the width direction W from upstream to downstream in the conveying direction X, and the first and second right rollers R1 and R2 are inclined from the middle to the right in the width direction W from upstream to downstream in the conveying direction X. It is noted that the middle rollers 81C, 82C, and 83C are supported to align in the conveying direction X.

Furthermore, the inclination angles of the first and second left rollers L1 and L2 and those of the first and second right rollers R1 and R2 relative to the conveying direction X (hereinafter simply referred to as "inclination angles") increase as the rollers are located outward from the middle in the width direction W. That is, the inclination angle of the second left rollers L2 is larger than the inclination angle of the first left rollers L1, and the inclination angle of the second right rollers R2 is larger than the inclination angle of the first right rollers R1. As an example, as shown FIG. 5, the inclination angle $\alpha$ (absolute value) of the first left roller 81L1 adjacent to the middle in the width direction W is 8°, whereas the inclination angle $\beta$ (absolute value) of the second left roller 81L2 on the outer side in the width direction W is 16°. Similarly, the inclination angle $\alpha$ (absolute value) of the first right roller 81R1 adjacent to the middle in the width direction W is 8°, whereas the inclination angle $\beta$ (absolute value) of the second right roller 81R2 on the outer side in the width direction W is 16°.

Furthermore, as shown in FIG. 4, in each conveying body, the rollers are disposed at regular intervals in the width direction W, and the distances between two adjacent rollers gradually increase from upstream to downstream in the conveying direction X. That is, the distance between two adjacent first rollers 81 of the first conveying body 41 is the shortest, whereas the distance between two adjacent third rollers 83 of the third conveying body 43 is the longest.

As shown in FIGS. 2 and 4, the first to third conveying bodies 41, 42, and 43 are disposed in the up-down direction with a predetermined space therebetween. In addition, as shown in FIG. 2, the first and third conveying bodies 41 and 43 are disposed at the same position in the front-rear direction, whereas the second conveying body 42 is disposed behind the first and third conveying bodies 41 and 43.

In addition, as shown in FIG. 2, the top of the first conveying body 41 and the bottom of the second conveying body 42 are located at substantially the same height, and the top of the second conveying body 42 and the bottom of the third conveying body 43 are located at substantially the same height. Since the first to third conveying bodies 41, 42, and 43 are disposed in this manner, when viewed from the front as shown in FIG. 4, the middle rollers 81C, 82C, and 83C of the first to third conveying bodies 41, 42, and 43, respectively, are aligned in the conveying direction X. In addition, the first left rollers 81L1, 82L1, and 83L1 are substantially aligned in a direction inclined at 8° to the left with respect to the conveying direction X, and the second left rollers 81L2, 82L2, and 83L2 are substantially aligned in a direction inclined at 16° to the left with respect to the conveying direction X. In addition, the first right rollers 81R1, 82R1, and 83R1 are substantially aligned in a direction inclined at 8° to the right with respect to the conveying direction X, and the second right rollers 81R2, 82R2, and 83R2 are substantially aligned in a direction inclined at 16° to the right with respect to the conveying direction X.

Furthermore, as shown in FIG. 2, the third tension roller 53 is disposed behind the first conveying body 41 such that the top of the third tension roller 53 and the bottom of the first conveying body 41 are located at substantially the same height. In addition, the fourth tension roller 54 is disposed behind the third conveying body 43 such that the top of the fourth tension roller 54 is located slightly higher than the top of the third conveying body 43.

Figure 6A:
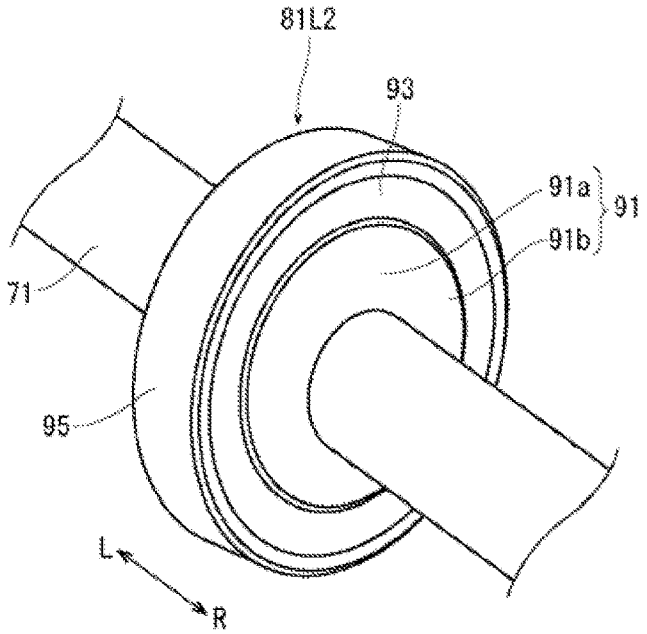
FIG. 6A is a perspective view of a roller in the recording apparatus according to the embodiment of the present disclosure.
Figure 6B:
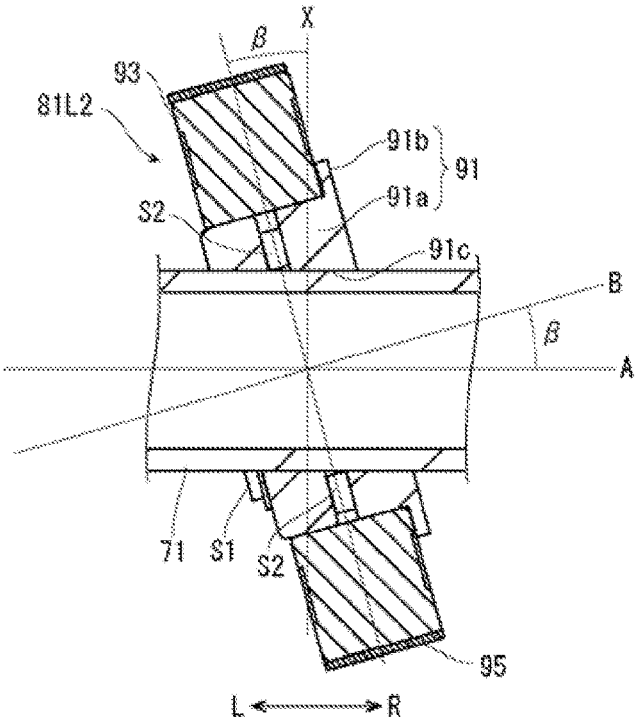
FIG. 6B is a cross-sectional view of the roller in the recording apparatus according to the embodiment of the present disclosure.

The following describes the rollers with reference to FIGS. 6A and 6B. FIG. 6A is a perspective view of the second left roller 81L2, and FIG. 6B is a cross-sectional view of the second left roller 81L2. Here, the second left roller 81L2 of the first conveying body 41 will be described.

The second left roller 81L2 includes a fixed member 91 fixed to the first shaft 71 and a rotating member 93 fitted on the fixed member 91. The fixed member 91 includes a base portion 91*a* having a short columnar shape and a flange portion 91*b* extending radially from an edge of the outer peripheral surface of the base portion 91*a*. The base portion 91*a* has a through-hole 91*c* through which the first shaft 71 is fitted. The axial direction A of the through-hole 91*c* is inclined at 16° in a predetermined direction with respect to the axial direction B of the base portion 91*a*.

The rotating member 93 is an annular member having a predetermined width. The rotating member 93 is rotatably fitted on the base portion 91*a* so as to abut on the flange portion 91*b* at one face and to be retained to the fixed member 91 with a screw 51 at another face.

The axial direction A of the through-hole 91*c* is inclined at 16° with respect to the axial direction B of the base portion 91*a*. Accordingly, when the first shaft 71 is fitted in the through-hole 91*c*, the rotating member 93 is inclined at 16° with respect to the conveying direction X. That is, the second left roller 81L2 is inclined at 16° with respect to the conveying direction X. As described above, in the fixed member 91 of each second left roller L2, the axial direction A of the through-hole 91*c* is inclined at 16° in the predetermined direction with respect to the axial direction B of the base portion 91*a*. In addition, in the fixed member 91 of each first left roller L1, the axial direction A of the through-hole 91*c* is inclined at 8° in the predetermined direction with respect to the axial direction B of the base portion 91*a*. On the other hand, in the fixed member 91 of each first right roller R1, the axial direction A of the through-hole 91*c* is inclined at 8° in a direction opposite the predetermined direction with respect to the axial direction B of the base portion 91*a*. In addition, in the fixed member 91 of each second right roller R2, the axial direction A of the through-hole 91*c* is inclined at 16° in the direction opposite the predetermined direction with respect to the axial direction B of the base portion 91*a*. In the fixed member 91 of each of the middle rollers 81C, 82C, and 83C, the axial direction A of the through-hole 91*c* is parallel to the axial direction B of the base portion 91*a*.

The first to third rollers 81, 82, and 83 of the first to third conveying bodies 41, 42, and 43, respectively, are disposed at predetermined positions along the first to third shafts 71, 72, and 73, respectively, such that the flange portions 91*b* are located inward in the width direction W. The base portions 91*a* are fixed to the first to third shafts 71, 72, and 73 with fixing screws S2.

Returning to FIG. 1, the first conveying roller pair 57 includes a drive roller and a driven roller pressed against the drive roller. The drive roller is driven by a motor (not shown) to rotate in a predetermined direction, and the driven roller is rotated by the rotation of the drive roller. The drive roller is driven such that the speed at which the medium M is conveyed is slightly higher than the speed at which the medium M is unwound from the supply roller 3.

The following describes the second conveying portion 13 with reference to FIG. 1. The second conveying portion 13 includes a conveyor belt 97 and a suction device 99. The conveyor belt 97 is an endless belt having a large number of air intakes. The conveyor belt 97 is wound around a drive roller and a driven roller such that the upper path thereof faces the ejection ports of the four recording heads 23C, 23M, 23Y, and 23K with a predetermined space between. The suction device 99 is disposed in a hollow portion inside the conveyor belt 97 to face the printing portion 5 with the upper path of the conveyor belt 97 therebetween. The suction device 99 generates an air current flowing from above the conveyor belt 97 to the inside of the conveyor belt 97 through the air intakes to cause the medium M conveyed along the upper path of the conveyor belt 97 to adhere to the conveyor belt 97. When the drive roller is driven to circulate the conveyor belt 97 in a predetermined direction (clockwise in FIG. 1), the medium M adhering to the upper path of the conveyor belt 97 is conveyed downstream while facing the printing portion 5.

Furthermore, as shown in FIG. 1, a second conveying roller pair 15 is disposed between the printing portion 5 and the drying portion 7. The second conveying roller pair 15 includes a drive roller and a driven roller pressed against the drive roller. The drive roller is driven by a motor (not shown) to rotate, and the driven roller is rotated by the rotation of the drive roller. The drive roller rotates in synchronization with the drive roller of the first conveying roller pair 57 in the first conveying portion 11.

Figure 7:
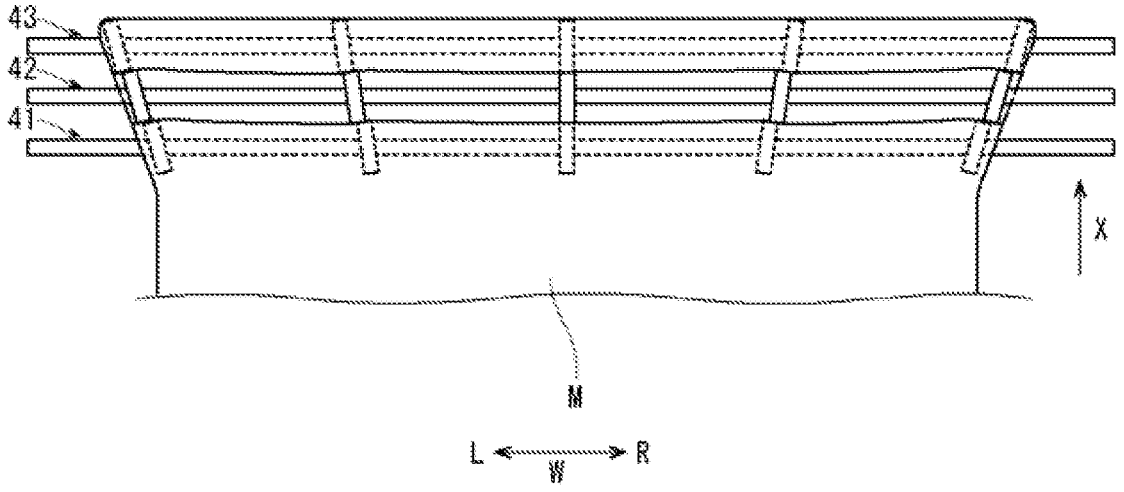
FIG. 7 is a schematic front view of a medium conveyed in the first conveying portion in the recording apparatus according to the embodiment of the present disclosure.

The following describes a printing operation of the recording apparatus 1 having the above-described configuration with reference to FIGS. 1 and 7. FIG. 7 is a schematic front view of the medium M conveyed in the first conveying portion 11.

Upon the start of the printing operation, the supply roller 3, the first conveying roller pair 57, the winding roller 9, and the like are driven by the motors to rotate, and the medium M is unwound from the supply roller 3 toward the first conveying portion 11 downstream in the conveying direction. The unwound medium M is wound around the first to third conveying bodies 41, 42, and 43 via the first to third tension rollers 51, 52, and 53.

More specifically, as shown in FIG. 2, the medium M extends forward from the third tension roller 53 substantially in the horizontal direction. The medium M is then wound approximately halfway around the first conveying body 41 from the underside of the first conveying body 41 and extends backward substantially in the horizontal direction. The medium M is then wound approximately halfway around the second conveying body 42 from the underside of the second conveying body 42 and extends forward substantially in the horizontal direction. Finally, the medium M is wound approximately halfway around the third conveying body 43 from the underside of the third conveying body 43 and extends obliquely upward to the fourth tension roller 54.

While the medium M is conveyed in the first conveying portion 11, the medium M is in contact with the outer peripheral surfaces of the rollers (the outer peripheral surfaces of the rotating members 93) of the first to third conveying bodies 41, 42, and 43, and the rollers rotate relative to the corresponding shafts. As described above, the rollers are supported to be inclined outward from upstream to downstream in the conveying direction X. Accordingly, the medium M is guided outward from the middle in the width direction W along the outer peripheral surfaces of the rollers. That is, as shown in FIG. 7, the medium M is pulled outward in the width direction W and stretched in the width direction. It is noted that "stretching the medium M" refers not to smoothing down the medium M, but to extending the elastic medium M. That is, the medium M has a width greater than that in its natural state without wrinkles. When the medium M is pulled outward in the width direction W, the medium M tries to contract inward in the width direction W due to its elasticity. The force in a direction of contraction is applied to the flange portions 91*b* of the fixed members 91.

Furthermore, the first conveying roller pair 57 is driven such that the speed at which the medium M is conveyed is slightly higher than the speed at which the medium M is unwound from the supply roller 3. Accordingly, the medium M unwound from the supply roller 3 is also stretched in the conveying direction X between the supply roller 3 and the first conveying roller pair 57.

The medium M is conveyed by the first conveying roller pair 57 to the second conveying portion 13 while being stretched in the width direction W and in the conveying direction X as described above. The medium M is conveyed downstream in the second conveying portion 13 while adhering to the upper path of the conveyor belt 97 by the suction device 99 as described above. While the medium M is conveyed, the recording heads 23C, 23M, 23Y, and 23K eject ink of respective colors corresponding to an image to be printed to record the image on the medium M. The medium M on which the image is recorded is dried in the drying portion 7 and then wound around the winding roller 9.

As described above, according to the recording apparatus 1 of the present disclosure, the medium M is conveyed while being stretched in the conveying direction X and in the width direction W. Accordingly, the medium M such as elastic fabric can be printed (subjected to textile printing) in the printing portion 5 while being stably conveyed. Thus, the performance in printing elastic fabric can be enhanced.

Specifically, in the first conveying portion 11, the first and second left rollers L1 and L2 and the first and second right rollers R1 and R2 of the conveying bodies are supported to be inclined outward with respect to the conveying direction X from upstream to downstream in the conveying direction X. Accordingly, the medium M is pulled outward in the width direction W and stretched in the width direction W.

Furthermore, the rollers on the outer side in the width direction W (the second left rollers L2 and the second right rollers R2) have a larger inclination angle than the rollers adjacent to the middle (the first left rollers L1 and the first right rollers R1). Accordingly, the medium M can be stretched evenly in the width direction W. Furthermore, the distances between two adjacent rollers increase downstream in the conveying direction X. Accordingly, the medium M can be stretched gradually and efficiently. It is noted that the distances between two adjacent rollers do not necessarily need to increase downstream in the conveying direction X. The distances between the rollers of the first to third conveying bodies 41, 42, and 43 may be the same.

Furthermore, as shown in FIG. 2, the medium M is wound approximately halfway around the first to third conveying bodies 41, 42, and 43. Accordingly, the central angles θ of the contact surfaces between the medium M and the first to third conveying bodies 41, 42, and 43 around the first to third shafts 71, 72, and 73 respectively corresponding to the first to third conveying bodies 41, 42, and 43 range from 170° to 180°. Increasing the areas of the contact surfaces between the medium M and the first to third conveying bodies 41, 42, and 43 as much as possible in this manner enables stable conveyance of the medium M while the medium M is being stretched. It is noted that the number of conveying bodies is not limited to three and may be any number greater than or equal to two. However, as the number of conveying bodies increases, the medium M can be stretched in smaller increments and thus stretched more stably. In addition, the number of rollers of the conveying bodies is not limited to five. However, it is preferable that, in a case where the number is small, the width of the rollers be increased to increase the areas of the contact surfaces with the medium M.

Figure 8A:
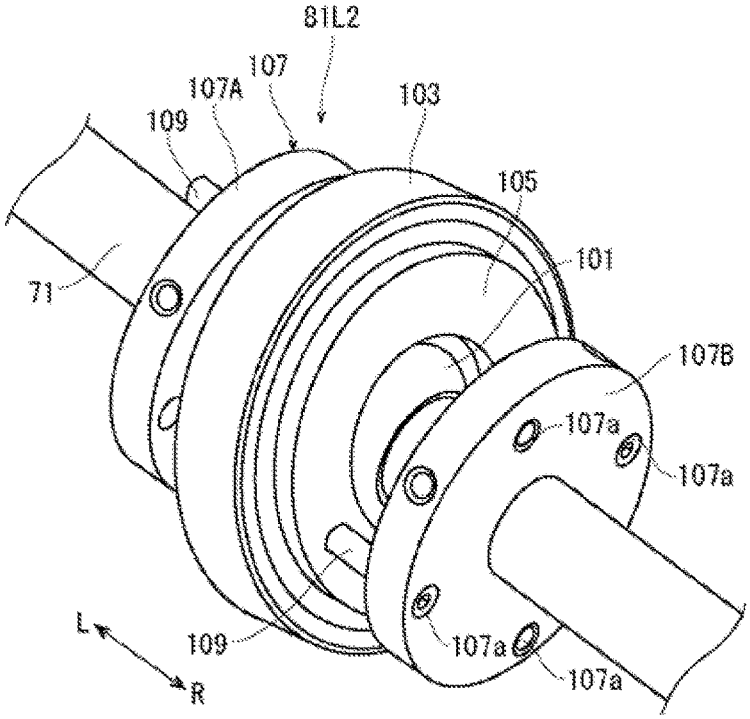
FIG. 8A is a perspective view of a modification of the roller in the recording apparatus according to the embodiment of the present disclosure.
Figure 8B:
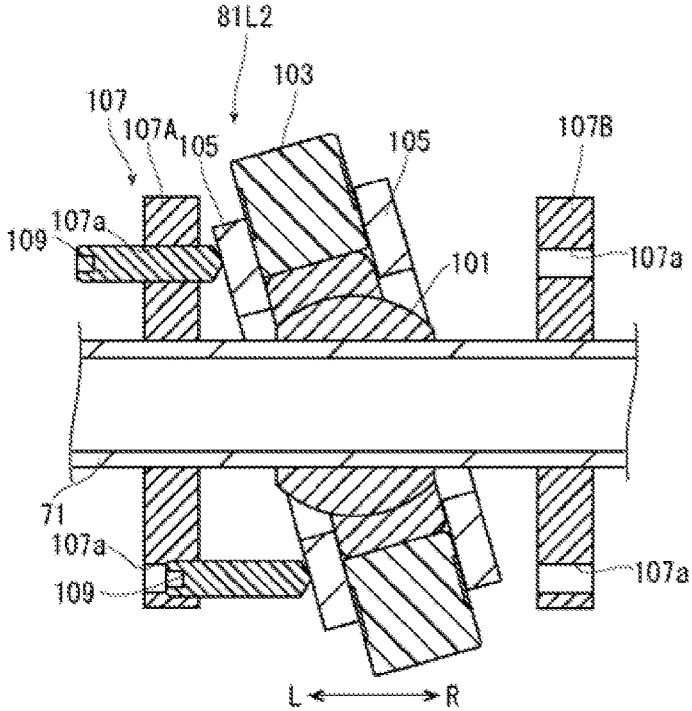
FIG. 8B is a cross-sectional view of the modification of the roller in the recording apparatus according to the embodiment of the present disclosure.

The following describes a modification of the rollers with reference to FIGS. 8A and 8B. FIG. 8A is a perspective view of the second left roller 81L2, and FIG. 8B is a cross-sectional view of the second left roller 81L2. Here, the second left roller 81L2 of the first conveying body 41 will be described. The other rollers have the same configuration.

The second left roller 81L2 includes a spherical bearing 101, a rotating member 103, a pair of washers 105, a pair of supporting members 107, and a plurality of (four in this example) ball plungers 109.

The inner ring of the spherical bearing 101 is fitted on the first shaft 71. The rotating member 103 is an annular member having a predetermined width and rotatably engages with the outer ring of the spherical bearing 101. The pair of washers 105 are fixed to the outer ring of the spherical bearing 101 while holding the rotating member 103 from both sides in the width direction W.

The pair of supporting members 107 are disk-shaped members each having a shaft hole through which the first shaft 71 is placed. Each of the supporting members 107 has four screw holes 107*a* formed at the same central angle (90°) around the shaft hole to be parallel to the shaft hole. The pair of supporting members 107 are fixed to the first shaft 71 with fixing screws on both sides of the spherical bearing 101. The pair of supporting members 107 are positioned such that the four screw holes 107*a* are symmetric about the first shaft 71 in the up-down direction and in the front-rear direction.

Two of the ball plungers 109 are respectively screwed into two (upper and lower) of the screw holes 107*a* in a supporting member 107A (one of the supporting members 107 on the outer side in the width direction W) to be reciprocable in a direction from the supporting member 107A to the rotating member 103 (inward in the width direction W). The distal ends of the ball plungers 109 abut on the corresponding washer 105. The other two ball plungers 109 are respectively screwed into two (front and rear) of the screw holes 107*a* in a supporting member 107B (the other supporting member 107 on the inner side in the width direction W) to be reciprocable in a direction from the supporting member 107B to the rotating member 103 (outward in the width direction W). The distal ends of the ball plungers 109 abut on the corresponding washer 105.

The two ball plungers 109 on the outer side are disposed such that the protruding length of the upper ball plunger 109 from the supporting member 107A to the distal end thereof is shorter than the protruding length of the lower ball plunger 109 from the supporting member 107A to the distal end thereof. In addition, the protruding lengths of the two inner ball plungers 109 from the supporting member 107B to the distal ends thereof are equal and are approximately intermediate between the protruding lengths of the two outer ball plungers 109. By setting the protruding lengths of the ball plungers 109 to their distal ends in this manner, the inclination angle of the rotating member 103 is set to a predetermined angle (for example, 16°) by the two outer ball plungers 109, and the rotating member 103 is prevented from falling over by the two inner ball plungers 109.

According to the modification, the inclination angle of the rotating member 103 (the inclination angle of the roller) can be adjusted by adjusting the protruding lengths of the two outer ball plungers 109 to their distal ends. Thus, the extensity of the medium M in the width direction W can be adjusted according to the elasticity and printing characteristics of the medium M. Specifically, the amount of extension can be increased by increasing the inclination angle. The ball plungers can be moved back and forth manually or automatically using motors.

Furthermore, the positions of the rollers in the width direction W can also be adjusted according to the width of the medium M by loosening the fixing screws and moving the pair of supporting members 107 and the spherical bearing 101 in the axial direction of the first shaft 71. Even with the medium M of the same type, the medium M differs in the amount of expansion and contraction depending on the width thereof. Accordingly, it is preferable that the positions and the inclination angles of the rollers be adjusted according to the width of the medium M.

In addition, in the above-described embodiment, as shown in FIGS. 6A and 6B, a friction member 95 may be affixed to the outer peripheral surface of each roller. The friction coefficient between the friction members 95 and the medium M is greater than the friction coefficient between the outer peripheral surfaces of the rollers and the medium M. As an example, the friction members 95 are abrasive paper with grid sizes between 40 and 100. In this case, the frictional force between the medium M and the rollers can be increased, and thus the medium M can be conveyed more stably. The friction members 95 may be formed from rubber or the like. Alternatively, the outer peripheral surfaces of the rollers may be roughened.

The present disclosure has been described by taking a specific embodiment as an example. However, the present disclosure is not limited in particular to the above-described embodiment. Various modifications can be made to the above-described embodiment by those skilled in the art within the scope and spirit of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A recording apparatus comprising:
a printing portion configured to eject liquid to print a medium having elasticity; and
a first conveying portion disposed upstream of the printing portion in a conveying direction along which the medium is conveyed to the printing portion, wherein
the first conveying portion includes at least two conveying bodies disposed in the conveying direction and around which the medium is alternately wound,
the conveying bodies each include:
a shaft extending in a width direction orthogonal to the conveying direction; and
a plurality of rollers rotatably supported by the shaft,
the plurality of rollers are supported to be inclined outward with respect to the conveying direction from upstream to downstream in the conveying direction,
the plurality of rollers are disposed to be symmetric about a middle in the width direction, and
inclination angles of the rollers relative to the conveying direction increase as the rollers are located outward in the width direction.

2. The recording apparatus according to claim 1, wherein
the plurality of rollers are disposed at regular intervals in the width direction, and distances between two adjacent rollers increase downstream in the conveying direction.

3. The recording apparatus according to claim 1, wherein
central angles of contact surfaces between the rollers and the medium around the respective shafts range from 170° to 180°.

4. The recording apparatus according to claim 1, wherein
inclination angles of the rollers relative to the conveying direction are variable.

5. The recording apparatus according to claim 4, wherein
the rollers each include:
a spherical bearing supported by the shaft;
a rotating member rotatably supported by the spherical bearing;
a pair of supporting members fixed to the shaft on both sides of the spherical bearing in the width direction; and
a plurality of ball plungers having distal ends abutting on the rotating member and supported to be reciprocable in directions from each of the pair of supporting members to the rotating member, and
inclination angles of the rotating members relative to the conveying direction can be changed by adjusting protruding lengths of the respective ball plungers.

6. The recording apparatus according to claim 1, wherein
the plurality of rollers are provided with friction members disposed on outer peripheral surfaces thereof, and
the friction members are abrasive paper with grid sizes between 40 and 100.

7. A recording apparatus comprising:
a printing portion configured to eject liquid to print a medium having elasticity; and
a first conveying portion disposed upstream of the printing portion in a conveying direction along which the medium is conveyed to the printing portion, wherein
the first conveying portion includes at least two conveying bodies disposed in the conveying direction and around which the medium is alternately wound,
the conveying bodies each include:
a shaft extending in a width direction orthogonal to the conveying direction; and
a plurality of rollers rotatably supported by the shaft,
the plurality of rollers are supported to be inclined outward with respect to the conveying direction from upstream to downstream in the conveying direction,
the plurality of rollers are disposed at regular intervals in the width direction, and
distances between two adjacent rollers increase downstream in the conveying direction.

8. The recording apparatus according to claim 7, wherein
central angles of contact surfaces between the rollers and the medium around the respective shafts range from 170° to 180°.

9. The recording apparatus according to claim 7, wherein inclination angles of the rollers relative to the conveying direction are variable.

10. The recording apparatus according to claim 9, wherein the rollers each include:

a spherical bearing supported by the shaft;

a rotating member rotatably supported by the spherical bearing;

a pair of supporting members fixed to the shaft on both sides of the spherical bearing in the width direction; and a plurality of ball plungers having distal ends abutting on the rotating member and supported to be reciprocable in directions from each of the pair of supporting members to the rotating member, and inclination angles of the rotating members relative to the conveying direction can be changed by adjusting protruding lengths of the respective ball plungers.

11. The recording apparatus according to claim 7, wherein the plurality of rollers are provided with friction members disposed on outer peripheral surfaces thereof, and the friction members are abrasive paper with grid sizes between 40 and 100.

12. A recording apparatus comprising:

a printing portion configured to eject liquid to print a medium having elasticity; and a first conveying portion disposed upstream of the printing portion in a conveying direction along which the medium is conveyed to the printing portion, wherein the first conveying portion includes at least two conveying bodies disposed in the conveying direction and around which the medium is alternately wound, the conveying bodies each include:

a shaft extending in a width direction orthogonal to the conveying direction; and a plurality of rollers rotatably supported by the shaft, the plurality of rollers are supported to be inclined outward with respect to the conveying direction from upstream to downstream in the conveying direction, inclination angles of the rollers relative to the conveying direction are variable, the rollers each include:

a spherical bearing supported by the shaft;

a rotating member rotatably supported by the spherical bearing;

a pair of supporting members fixed to the shaft on both sides of the spherical bearing in the width direction; and a plurality of ball plungers having distal ends abutting on the rotating member and supported to be reciprocable in directions from each of the pair of supporting members to the rotating member, and inclination angles of the rotating members relative to the conveying direction can be changed by adjusting protruding lengths of the respective ball plungers.

13. The recording apparatus according to claim 12, wherein central angles of contact surfaces between the rollers and the medium around the respective shafts range from 170° to 180°.

14. The recording apparatus according to claim 12, wherein the plurality of rollers are provided with friction members disposed on outer peripheral surfaces thereof, and the friction members are abrasive paper with grid sizes between 40 and 100.

* * * * *